US006581802B1

(12) United States Patent
Sperber

(10) Patent No.: US 6,581,802 B1
(45) Date of Patent: Jun. 24, 2003

(54) LIQUID SUPPLY DEVICE

(75) Inventor: Karlheinz Sperber, Diedorf (DE)

(73) Assignee: Baldwin Germany GmbH (DE)

( * ) Notice: Subject to any disclaimer, the term of this patent is extended or adjusted under 35 U.S.C. 154(b) by 0 days.

(21) Appl. No.: 09/604,497

(22) Filed: Jun. 27, 2000

(30) Foreign Application Priority Data

Jun. 29, 1999 (DE) ..... 199 29 844

(51) Int. Cl.[7] ..... B65D 35/56

(52) U.S. Cl. ..... 222/105; 222/95; 222/81; 101/147; 101/148

(58) Field of Search ..... 222/105, 183, 222/95, 81, 82; 101/147, 148

(56) References Cited

U.S. PATENT DOCUMENTS 2,618,409 A * 11/1952 Eisenberger et al. ..... 222/105
3,249,031 A * 5/1966 Gold ..... 95/13
3,651,756 A * 3/1972 Smith, Jr. ..... 101/147
3,764,070 A * 10/1973 Glasser ..... 239/93
4,258,862 A * 3/1981 Thorsheim ..... 222/56
4,484,697 A * 11/1984 Fry, Jr. ..... 222/95
4,776,488 A * 10/1988 Gurzan ..... 222/81
5,025,722 A * 6/1991 Switall et al. ..... 101/147
5,115,844 A * 5/1992 Hansen ..... 144/2 R
5,181,467 A * 1/1993 Takekoshi ..... 101/147
5,264,899 A * 11/1993 Mandel ..... 355/200
5,368,195 A * 11/1994 Pleet et al. ..... 222/52
5,368,817 A * 11/1994 Sudo et al. ..... 422/62
5,463,951 A * 11/1995 Waizmann et al. ..... 101/423
5,727,471 A * 3/1998 Iwafune et al. ..... 101/477
5,826,514 A * 10/1998 Romero Salvo ..... 101/483
5,870,952 A * 2/1999 Eichner et al. ..... 101/148
5,992,317 A * 11/1999 Hummel et al. ..... 101/148
6,053,360 A * 4/2000 Rutter ..... 222/1
6,152,032 A * 11/2000 Belanger et al. ..... 101/147
6,257,144 B1 * 7/2001 Erhardt et al. ..... 101/484

* cited by examiner

*Primary Examiner*—David A. Scherbel
*Assistant Examiner*—Frederick C. Nicolas
(74) *Attorney, Agent, or Firm*—Ostrolenk, Faber, Gerb & Soffen, LLP

(57) ABSTRACT

A liquid supply device, particularly for gluing machines, coating machines, paper moistening machines and printing machines. It includes an airtight container of collapsible design including at least one collapsible wall. The container collapses corresponding to the quantity of liquid sucked out of it by a suction pump. The collapsible container may be disposed in a rigid container with walls that support the collapsible container walls from folding over.

18 Claims, 2 Drawing Sheets

LIQUID SUPPLY DEVICE

BACKGROUND OF THE INVENTION

The invention relates to a liquid supply device for supplying machines with a liquid from a container wherein air is not drawn into the container.

Prior art includes DE 82 26 904 U1, DE 44 16 089 A1, DE 33 34 930 A1, DE 296 23 705 U1, DE 195 03 234 A1, and JP 3-246379 A.

Liquids, such as glue, ink and varnish, as well as organic detergents, should be kept in a liquid-tight manner so that they do not dry out and become unable to react with oxygen, their volatile constituents cannot evaporate, and no bacterial cultures can develop in them.

Such liquids are usually kept in containers or canisters made of polymer or metal. If the liquid is delivered from such a container using a pressure pump, air is forced into the container. As a result, the liquid can react with the oxygen in the air, volatile constituents can escape from the liquid, and the delivery rate is limited, since the containers do not withstand high air pressures from the pressure pump, or else containers made of very thick polymer material or metal are used. The use of containers with thick polymer walls or containers made of metal is expensive for their production and very expensive for their disposal (sometimes as special industrial waste) or for recycling, and the containers have a high weight. The limited pressure resistance of the containers limits the delivery pressure of the pressure pump and therefore limits the delivery rate of the liquid. This restricts the production speed of a machine being supplied with the liquid.

One preferred application of the invention relates to gluing machines. Glue that is to be applied to finished paper is fed from a container, for example a canister, in order to adhere paper sheets or paper webs together. Instead of paper, use can also be made of films in the form of sheets (leaves) or endless webs of polymer, metal, cork or another metal.

Another preferred application of the invention is in a coating machine for coating carrier material with a coating material. The carrier material is preferably paper in the form of paper sheets or paper webs. Films in the form of sheets or webs of polymer, metal, cork or another metal can also be coated. The coating material is preferably ink or varnish.

A further preferred application for the invention is machines or apparatus for moistening finished paper, in order to achieve a desired moisture content and to keep that content at a predetermined value or within a predetermined value range. This is done, for example, by using so-called softening liquid, which can be water, to make paper easier to crease in order that it does not tear in folding. Softening liquid may particularly be commercially available folding-aid concentrate, which is a mixture of water and additives, for example vinegar and/or washing-up liquid.

A further preferred application for the invention is printing machines, particularly sheet-fed printing machines and web-fed printing machines, and more particularly offset printing machines. Offset printing machines use so-called dampening solution to form ink-repellent regions on a printing plate cylinder. The dampening solution consists of water, alcohol or alcohol substitute and so-called additives. According to the invention, these liquid additives can be delivered from an airtight supply container to a dampening-solution preparation trough on the printing machine, without the additive coming into contact with air. This prevents an organic additive being infected by bacteria or fungi or being able to react with oxygen.

In the prior art, the liquid is forced out of the container by a pressure pump. This has the disadvantage that, at too high a delivery pressure, there is the risk that the container will burst. In addition, there is the risk that the compressed air from the pressure pump will react chemically with the liquid, or that bacteria or fungi might develop in the liquid.

It is also already known to suck liquid from a dimensionally stable canister with a suction pump. However, this has the disadvantages that either a vacuum that counteracts the pump suction force is formed in the dimensionally stable canister or the canister has to be vented. This leads to contact between the liquid and air or oxygen. The abovementioned disadvantages cause the liquid to dry out, or it may react with oxygen and/or bacteria or fungi may form in the liquid or in the canister. The same disadvantage as when the canister is vented also results if pressure pumps are used, because of the air delivered into the canister by the pumps.

SUMMARY OF THE INVENTION

The invention has the object of providing one possibility for delivering any desired quantities of liquid from the container while the outlay for material, the weight and the costs for the container and container disposal or recycling can be reduced, and contact between the liquid in the container and air or other gases can be avoided.

According to the invention, this object is achieved by a container according to the invention. At least one wall, and preferably all of the walls of the container are designed so that they can be deformed or deflected by the suction force of the suction pump which delivers the liquid and, at the same time, the container walls can be moved toward each other, without requiring the suction force of the suction pump to be significantly higher than that suction required for sucking the liquid out of an open container.

For this purpose, the container walls can be dimensionally unstable, e.g., the walls have either no stiffness or a stiffness that is so low that the walls can be bent easily and cannot stand upright independently without bending over, folding over or folding in on themselves.

According to another preferred embodiment, the walls of the container are dimensionally stable, but can be deformed plastically even by a low suction force applied by the suction pump. This means that following their plastic deformation, the container walls maintain their now deformed shape when the deformation producing forces are reduced.

Preferred fields of application of the invention are for gluing machines, coating machines and printing machines. In gluing machines and coating machines, the liquid is applied to a carrier in the form of finished paper or film. It is possible for the film to be metal, polymer, cork or another material.

According to another field of application of the invention, the liquid is a moistening liquid, for example water, for moistening finished paper in order that it can subsequently be creased more easily or can be folded in a folder without the paper tearing.

Furthermore, the invention can be used for offset printing machines, in order to feed liquid additive from a collapsible container to a mixing container, in which the additive is mixed with water and alcohol or an alcohol substitute in order to form dampening solution, which is fed to a printing plate cylinder to form ink-repellent regions. The dampening solution can also be fed to cylinders or rollers of the printing machine, for example paper guide rolls and cooling rolls, in order to prevent or to remove contamination, for example deposits of printing ink.

Other objects and features of the invention are described below, using preferred embodiments as examples and with reference to the accompanying drawings.

DESCRIPTION OF PREFERRED EMBODIMENTS

Figure 1:
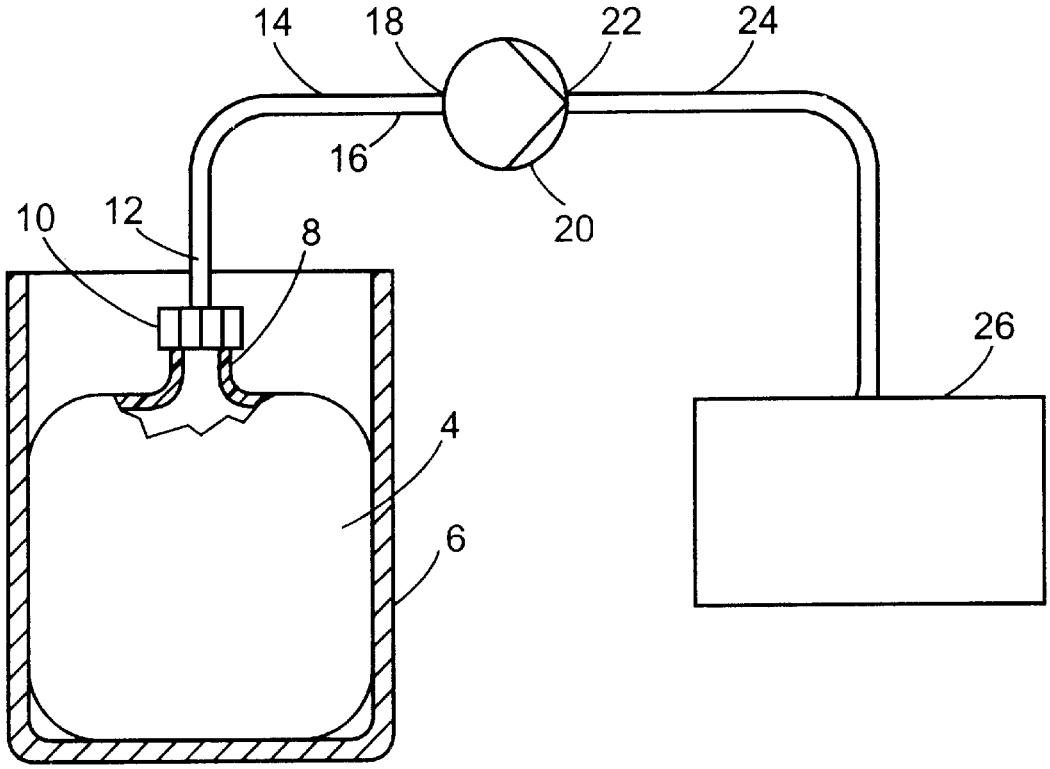
FIG. 1 shows schematically a liquid supply device according to the invention on a reduced scale.

FIG. 1 shows an inner container 4 which can be collapsed by the suction force of a suction pump 20, disposed in an outer container 6 made of non-collapsible, rigid material which supports the inner container laterally The collapsible container 4 has a top end with a threaded neck 8 to which the end 12 of a fluid line 14 is connectable in an airtight manner by a threaded sleeve 10. The other end 16 of the fluid line 14 is connectable to the suction side 18 of a suction pump 20.

The pressure side 22 of the suction pump 20 is connected via a further fluid line 24 to a machine 26, of any of the types noted above, to which liquid from the container 4 can be fed by the suction pump 20.

The container 4 is designed to be collapsible such that it can easily be collapsed by the subatmospheric pressure generated by the suction pump 20, and the container collapses corresponding to the quantity of liquid sucked from it. The container offers only very low resistance to the suction force from the suction pump 20.

The walls of the container 4 can be very dimensionally unstable, so that they either have no stiffness or a stiffness that is only low and is insufficient for the walls to stand upright independently without bending over, folding over or folding in on themselves.

According to another embodiment of the invention, although the walls of the container 4 are dimensionally stable, they can be easily deformed plastically under application of an extremely low force, which is applied by the delivery suction force of the suction pump 20. This ability of the walls to be easily deformed plastically causes the container 4 to maintain its deformed shape when the suction force from the suction pump 20 is reduced.

For both described embodiments, it is advantageous to accommodate the container 4 in a dimensionally stable outer container 6, which has side walls that support the container 4 on all its sides. The outer container 6 not only makes transport of the dimensionally unstable inner container 4 easier but also prevents the inner container being damaged.

Figure 2:
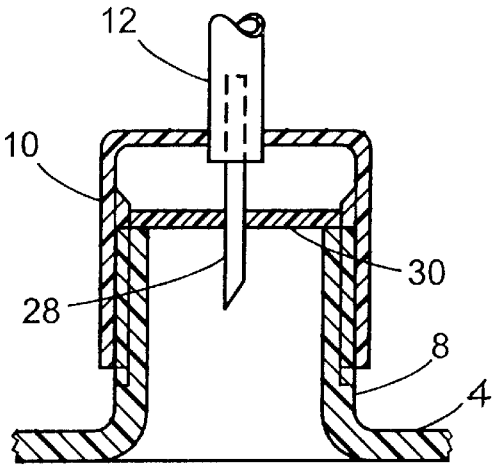
FIG. 2 shows an enlarged detail from FIG. 1, in cross section.

In a preferred embodiment the container 4 is formed of a flexible polymer or rubber. Such containers can be produced simply and inexpensively with very thin walls, for example by cutting sections of tube from a film-like, thin polymer tube and welding both their ends together. During the welding, a line connection can be formed at one end of the tube at the same time. This connection is illustrated symbolically in FIGS. 1, 2 and 3 in the form of the neck 8.

The end 12 of the suction fluid line 14 that is to be connected to the container 4 can be designed as a penetration tube 28 or may be provided with such a penetration tube 28 in order to penetrate a container closure 30 on the neck 8. The container closure 30 can be a film welded onto the neck 8 or can be formed by the container 4 itself. The penetration tube 28 can be used without the threaded sleeve 10 or can be designed such that when the threaded sleeve 10 is screwed onto the neck 8, it is automatically pushed through the container closure 30.

Instead of a penetration tube 28, that end of the suction fluid line 14 that is to be connected to the container 4 can have a penetration element in the form of a blade-like or needle-like tip which does not have a liquid passage opening.

In this case, it is necessary not only for this penetration element but also the end 12 of the suction fluid line 14 to project into the neck 8 or at least through the threaded sleeve 10 or to have a fluid connection to the latter.

The container 4 does not require a neck 8. Instead, the line connection formed by the neck 8 on the container 4 can also be formed by a flat or differently shaped container wall of the container 4, which can be the top wall, a bottom wall or a side wall of the container 4.

The machine 26 can be any of the aforementioned types.

Figure 3:
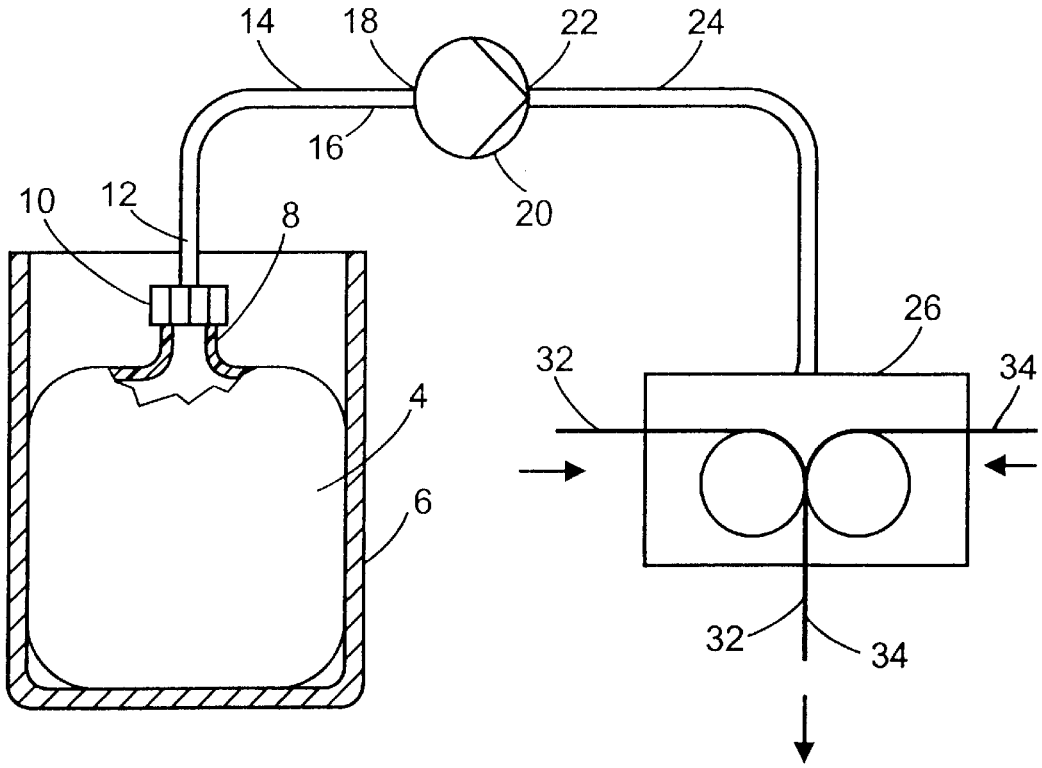
FIG. 3 shows the liquid supply device of FIGS. 1 and 2 in an application on a gluing machine.

FIG. 3 shows, as an example, a web gluing machine 26, in which glue from the container 4 is applied to one or both webs 32 and 34, for example paper webs, which are bonded to each other by the glue. Gluing machines and the other types of machine on which the invention may be used are known in practice and will therefore not be described in detail.

The container 4 is designed such that it collapses essentially continuously, following the removal of liquid and approximately corresponding to the quantity of liquid sucked out by the suction pump 20.

The collapsible container 4 preferably has the form of a flexible bag. The holding capacity of the collapsible container 4 is at least one liter (one cubic decimeter).

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A liquid supply in combination with an offset-printing machine, the combination comprising:

an offset-printing machine apparatus for treating sheets or a web;

a supply container for a liquid for teeing the sheets or web, the container being sealed against exposure to air and collapsible, such that the container is easily collapsed by sub-atmospheric pressure in the interior of the container;

a suction pump having a suction side connectable to the container for sucking liquid out of the container and having a pressure side for delivering a quantity the liquid outside the container and collapsing the container as a result of a suction force from the suction pump, the container collapse corresponding to the quantity of liquid sucked out, said liquid for treating said sheet or web in said offset-printing machine apparatus being delivered to the apparatus without coming into contact with air; and a tube provided with a connecting means for engaging the liquid supply container and establishing an airtight line connection between liquid in the liquid supply container and the suction pump.

2. The apparatus of claim 1, wherein the container comprises at least one wall which is dimensionally unstable, the one wall having no stiffness or a stiffness that is so low that the one wall can be bent easily and cannot stand upright independently without bending over, folding over or folding in on itself.

3. The apparatus of claim 1, wherein the container comprises at least one wall, which can easily be deformed plastically by the vacuum in the container from the suction pump and which has no significant inherent deformation restoring forces, so that when the suction force from the pump in the container is reduced, the one wall essentially maintains its deformation that has been produced by the suction force.

4. The apparatus of claim 1 wherein the pressure side of the suction pump is connectable to a glue application machine, and wherein the liquid stored in the collapsible container comprises glue.

5. The apparatus of claim 1, wherein the pressure side of the suction pump is connectable to a folding-aid apparatus for moistening a paper web upstream of a paper-web folder, and wherein the liquid stored in the collapsible container is water or a mixture of water and at least one additive.

6. The apparatus of claim 1, wherein the pressure side of the suction pump is connectable to a coating machine for a film of a material and wherein the liquid stored in the collapsible container is a coating liquid.

7. The apparatus of claim 1, wherein the pressure side of the suction pump is connectable to an offset printing machine, and wherein the liquid stored in the collapsible container is an additive for preparing offset printing dampening solution.

8. The apparatus of claim 1, wherein the pressure side of the suction pump is connected to a machine for moistening paper, in order to make the paper easier to bend and to crease without tearing.

9. The apparatus of claim 2, wherein the dimensionally unstable wall of the collapsible container consists of a polymer or rubber.

10. The apparatus of claim 1, wherein the collapsible container has holding capacity of at least one liter.

11. The apparatus of claim 1, wherein the collapsible container comprises a flexible bag.

12. The apparatus of claim 1, further comprising a dimensionally stable outer container in which the collapsible container filled with liquid is disposed, and the dimensionally stable container has walls which hold the collapsible container in a predetermined position.

13. The apparatus of claim 1, wherein the connecting element provided on the tube comprises a threaded sleeve.

14. The apparatus of claim 1, wherein the connecting element provided on the tube comprises a penetration element for penetrating the liquid supply container.

15. A process for delivering a stored liquid to an offset-printing machine apparatus of an offset-printing plant for treating sheets or a web offset-printed by said offset printing machine, said process comprising the steps of:

retaining liquid airtight in a collapsible storage container;

engaging the storage container with a supply tube provided with an air-tight connector so as to establish an airtight line connection to the liquid in the collapsible storage container;

applying a suction force to the container through the supply tube to suck out the liquid through the supply tube, and to the extent to which the liquid is sucked out, at the same time reducing the volume of the interior of the container by collapse of the container walls;

delivering the liquid to said offset-printing machine apparatus through a delivery tube without the liquid coming into contact with air; and treating said sheets or web by applying said liquid in said offset-printing machine apparatus of said offset-printing plant.

16. The process of claim 15, further comprising the step of retaining the collapsible container in a rigid container for preventing complete collapse of the wall of the collapsible container.

17. The process of claim 15, wherein the step of engaging the storage container with a supply tube comprises engaging a threaded neck on the storage container with a supply tube provided with a threaded sleeve.

18. The process of claim 15, wherein the step of engaging the storage container with a supply tube comprises penetrating the storage container with a supply tube provided with a penetration element.

* * * * *